US012624843B2

(12) United States Patent
Tsamis et al.

(10) Patent No.: US 12,624,843 B2
(45) **Date of Patent: *May 12, 2026**

(54) HYDRONIC SYSTEM AND METHOD FOR HEATING AND COOLING A BUILDING

(71) Applicant: Rensselaer Polytechnic Institute, Troy, NY (US)

(72) Inventors: Alexandros Tsamis, Brooklyn, NY (US); Theodorian Borca-Tasciuc, Troy, NY (US); Youngjin Hwang, Brooklyn, NY (US)

(73) Assignee: Rensselaer Polytechnic Institute, Troy, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/678,041

(22) Filed: May 30, 2024

(65) Prior Publication Data

US 2024/0318834 A1 Sep. 26, 2024

Related U.S. Application Data

(63) Continuation of application No. 17/879,234, filed on Aug. 2, 2022, now Pat. No. 12,031,730.
(Continued)

(51) Int. Cl.
*F24D 3/14* (2006.01)
*E04C 2/52* (2006.01)
(Continued)

(52) U.S. Cl.
CPC ..... *F24D 3/145* (2013.01); *E04C 2/525* (2013.01); *F24D 19/1015* (2013.01);
(Continued)

(58) Field of Classification Search
CPC .. F24D 19/1039; F24D 19/1015; F24D 3/145; F24D 2220/006; F24F 5/0003; F24F 5/0089; F24F 2221/54; E04C 2/525
See application file for complete search history.

(56) References Cited

U.S. PATENT DOCUMENTS 5,261,251 A 11/1993 Galiyano
8,041,461 B2 10/2011 Milder et al.
(Continued)

FOREIGN PATENT DOCUMENTS

CA 2841378 C 9/2014
WO 2021050014 A1 3/2021

*Primary Examiner* — Frantz F Jules
*Assistant Examiner* — Martha Tadesse
(74) *Attorney, Agent, or Firm* — Barclay Damon LLP; Anthony P. Gangemi

(57) ABSTRACT

A hydronic system includes a partition, a first conduit embedded in a first side of the partition, a second conduit embedded in a second side of the partition, a first sheet of finishing material covering the first conduit, a second sheet of finishing material covering the second conduit, and at least one valve and at least one pump. The at least one valve and at least one pump are configured to control a flow of a fluid inside the first conduit and the second conduit. When the hydronic system is operating in an isolating mode, the fluid flows in a first closed loop through the first conduit and the fluid flows in a second closed loop through the second conduit. When the hydronic system is operating in a heat exchange mode, the fluid flows between the first conduit and the second conduit in a third closed loop.

20 Claims, 17 Drawing Sheets

Related U.S. Application Data

(60) Provisional application No. 63/228,233, filed on Aug. 2, 2021.

(51) Int. Cl.
*F24D 19/10* (2006.01)
*F24F 5/00* (2006.01)

(52) U.S. Cl.
CPC ..... *F24D 19/1039* (2013.01); *F24F 5/0089* (2013.01); *F24D 2220/006* (2013.01); *F24D 2220/042* (2013.01)

(56) References Cited

U.S. PATENT DOCUMENTS 8,122,944 B2 2/2012 Clark
8,126,595 B2 2/2012 Milder et al.
8,322,092 B2 12/2012 Isaacs
8,397,799 B2 3/2013 Blecker
8,474,514 B2 7/2013 Fischer
9,410,752 B2 8/2016 Wallace
10,638,639 B1 4/2020 Garner et al.
10,697,174 B1 * 6/2020 Bomberg ..... B32B 5/26
10,907,848 B2 2/2021 Wallace
2003/0066638 A1 * 4/2003 Qu ..... F22B 21/00 257/E23.11
2005/0167092 A1 * 8/2005 Comeaux ..... F24F 5/0017 165/219
2008/0086981 A1 4/2008 Kilkis et al.
2008/0271881 A1 11/2008 Blecker
2008/0314552 A1 12/2008 Rosenkranz et al.
2011/0100590 A1 * 5/2011 Isaacs ..... F24D 3/005 165/56
2012/0261091 A1 * 10/2012 Krecke ..... F24F 12/006 165/56
2015/0047807 A1 2/2015 Fiedrich
2018/0283711 A1 * 10/2018 Hall ..... E04B 1/806
2019/0309959 A1 10/2019 Hall et al.

* cited by examiner

HYDRONIC SYSTEM AND METHOD FOR HEATING AND COOLING A BUILDING

CROSS REFERENCE TO RELATED APPLICATION(S)

This application is a continuation application and claims the priority benefit of U.S. patent application Ser. No. 17/879,234, filed Aug. 2, 2022, which claims the priority benefit of U.S. Provisional Patent Application No. 63/228,233, filed Aug. 2, 2021, which are incorporated by reference as if disclosed herein in their entireties.

FIELD

The present technology relates to heating and cooling systems. More particularly, the present technology relates to a hydronic system for heating and cooling the rooms of a building.

BACKGROUND

Building sectors are currently responsible for consuming close to 40% of total U.S. primary energy use and are therefore a significant contributor to carbon emissions. Both residential and commercial buildings' energy use is dominated by space heating and cooling, which was 38% of the residential energy use and 29% of the commercial energy use in 2018 in the U.S. The building envelope is the largest single contributor to heating and cooling energy use. On average, about 50% of the thermal load comes directly through the building envelope, and the opaque building envelope—exterior walls, roof, and foundation—affects 25% of total building energy use, which is 10% of total U.S. primary energy use. Therefore, opaque envelope technologies can play a significant role in reducing energy use in buildings.

In order to mitigate undesirable heat exchange between the exterior and interior environment through a building envelope, an ideal envelope is considered to be one that offsets all heat transfer regardless of the interior space usage and fluctuating weather conditions to minimize the energy used for heating and cooling. Based on this ideal, the conventional model for building thermoregulation requires technology that maximizes the building's insulation, while all heating and cooling occurs internally through a thermoelectrical system. However, the conventional model has the disadvantages of being somewhat inefficient in that it fails to effectively utilize available hot sources and cold sinks.

What is needed, therefore, is an improved heating and cooling system that addresses at least the problems described above.

SUMMARY

Some embodiments of the present technology provide hydronic heating and cooling systems, which take a different approach from the conventional model. In hydronic systems according to some embodiments of the present technology, opaque building elements (e.g., floors, internal partitions, or external envelopes) have a dynamic behavior, increasing or decreasing their insulation value on demand, based on heating exchange demands and available resources. More specifically, in some embodiments, an integrated heating and cooling module is applied to various opaque building components (e.g., a slab, interior partition, or exterior envelope). In some embodiments, as hardware, the system is a climate adaptive building technology designed to actively manage thermal resistance and store thermal energy. In some embodiments, the system includes a double-sided microcapillary hydronic heating and cooling layer embedded in a composite structural insulation panel. Some embodiments of the invention include any container (e.g., a pipe, a thin panel, etc.) capable of holding a fluid (e.g., water) close to the interior and/or exterior surfaces of a building panel.

In some embodiments, the system is a cyber-physical system. In some embodiments, an integrated computational module regulates the dynamic thermal behaviors of the double-sided heating and cooling layer according to changes in environmental conditions, available renewable energy sources, and building thermal demands. In some embodiments, the system utilizes ambient renewable energy resources (e.g., solar, wind, geothermal energy, or low-temperature waste heat). In some embodiments, both the integrated micro-capillary hydronic layer in the inner layer and the integrated microcapillary hydronic layer in the outer layer of a structural element of a building dynamically receives and intelligently distributes available ambient energy via an optimal path through the entire opaque building elements. In some embodiments, the system is constructed by integrating thermal elements into prefabricated modular panels (e.g., structural insulated panels) In other embodiments, the double layer technology is used in other applications (e.g., in a building independently of modular construction).

According to an embodiment of the present technology, a hydronic system for heating and cooling the rooms of a building is provided. The hydronic system includes a partition, a first conduit embedded in a first side of the partition, a second conduit embedded in a second side of the partition, and at least one valve and at least one pump. The at least one valve and at least one pump are configured to control a flow of a fluid inside the first conduit and the second conduit. When the hydronic system is operating in an isolating mode, the fluid flows in a first closed loop through the first conduit and the fluid flows in a second closed loop through the second conduit. When the hydronic system is operating in a heat exchange mode, the fluid flows between the first conduit and the second conduit in a third closed loop.

In some embodiments, the hydronic system includes a first sensor that is configured to detect a first temperature on the first side of the partition, a second sensor that is configured to detect a second temperature on the second side of the partition, and a processor that is configured to select between the isolating mode and the heat exchange mode based on the detected first temperature and the detected second temperature and to control the at least one valve and the at least one pump according to the selected mode.

In some embodiments, the partition includes an insulation core, and an effective insulation value of the insulation core changes depending on whether the hydronic system is operating in the isolating mode or the heat exchange mode.

In some embodiments, the insulation core includes a rigid foam material.

In some embodiments, at least one of the first conduit and the second conduit includes a microcapillary layer. In some embodiments, the microcapillary layer includes a plurality of pipes in a parallel arrangement. In some embodiments, the microcapillary layer includes a plurality of pipes in a honeycomb-shaped arrangement. In some embodiments, the microcapillary layer includes a continuous pipe that has a plurality of bends.

In some embodiments, at least one of the first conduit and the second conduit includes a bladder.

In some embodiments, at least one of the first conduit and the second conduit includes a plurality of polycarbonate sheets.

In some embodiments, a first sheet of finishing material covers the first conduit, and a second sheet of finishing material covers the second conduit.

In some embodiments, at least one of the first sheet of finishing material and the second sheet of finishing material includes a fiber-reinforced polymer panel.

In some embodiments, a fluid collector is in fluid communication with the at least one pump.

In some embodiments, heat enters the hydronic system through a solar thermal energy collector.

In some embodiments, heat enters the hydronic system through a geothermal vertical loop.

In some embodiments, heat leaves the hydronic system through a geothermal horizontal loop.

In some embodiments, the partition, the first conduit, and the second conduit are provided as a prefabricated panel.

In some embodiments, the partition, the first conduit, the second conduit, the first sheet of finishing material, and the second sheet of finishing material are provided as a prefabricated panel.

In some embodiments, the partition, the first conduit, and the second conduit are installed in wet construction.

According to another embodiment of the present technology, a hydronic network for controlling the temperature within the room of a building is provided. The hydronic network includes a plurality of hydronic systems for heating and cooling the rooms of the building. Each of the plurality of hydronic systems is integrated into a floor, a ceiling, or a wall of the building. Each of the plurality of hydronic systems includes a partition, a first conduit embedded in a first side of the partition, a second conduit embedded in a second side of the partition, a first sheet of finishing material covering the first conduit, a second sheet of finishing material covering the second conduit, at least one valve and at least one system pump, a first sensor that is configured to detect a first temperature on the first side of the partition, and a second sensor that is configured to detect a second temperature on the second side of the partition. The at least one valve and at least one system pump are configured to control a flow of a fluid inside the first conduit and the second conduit. When the hydronic system is operating in an isolating mode, the fluid flows in a first closed loop through the first conduit and the fluid flows in a second closed loop through the second conduit. When the hydronic system is operating in a heat exchange mode, the fluid flows between the first conduit and the second conduit in a third closed loop. A network pump is configured to supply the fluid to the plurality of hydronic systems. A fluid collector is in fluid communication with the network pump. A processor is configured, for each of the plurality of hydronic systems, to select between the isolating mode and the heat exchange mode based on the detected first temperature and the detected second temperature and to control the at least one valve and the at least one system pump according to the selected mode.

In some embodiments, a solar thermal energy collector is configured to supply heat to the hydronic network.

In some embodiments, a geothermal vertical loop is configured to supply heat to the hydronic network, and a geothermal horizontal loop is configured to remove heat from the hydronic network.

Further objects, aspects, features, and embodiments of the present technology will be apparent from the drawing Figures and below description.

BRIEF DESCRIPTION OF DRAWINGS

Some embodiments of the present technology are illustrated as an example and are not limited by the figures of the accompanying drawings, in which like references may indicate similar elements.

DETAILED DESCRIPTION

Figure 1:
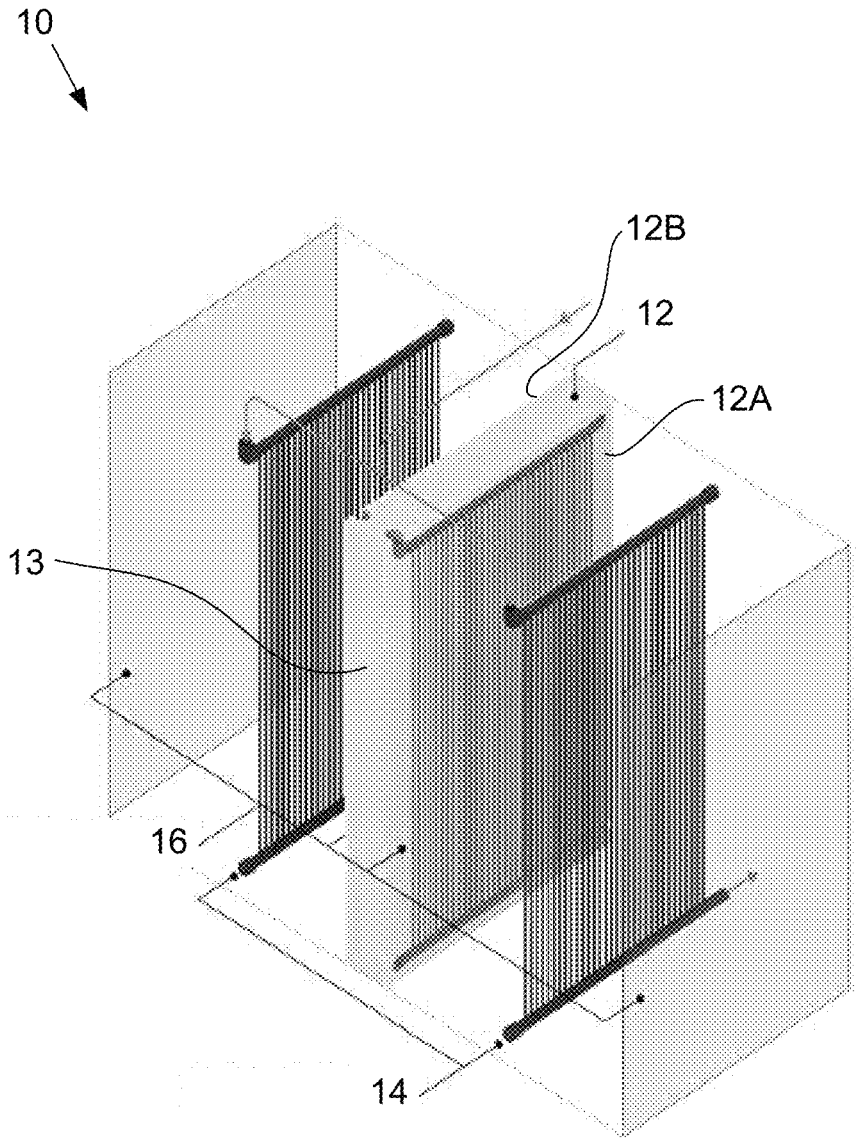
FIG. 1 is an exploded view of a hydronic system according to an embodiment of the present technology.

As shown in FIGS. 1-7, a hydronic system is generally designated by the numeral 10. The hydronic system 10 is configured for heating and cooling one or more rooms of a building. The hydronic system 10 includes a partition 12. In some embodiments, the partition 12 is an insulation panel or an opaque building element, such as a wall, a ceiling, a floor, or a combination thereof. In some embodiments, the partition 12 has an insulation core 13 that is formed of a rigid foam material that serves as insulation (e.g., insulation between the interior and the exterior of a building). A first conduit 14 is embedded in a first side 12A of the partition 12, and a second conduit 14 is embedded in a second side 12B of the partition 12. The conduits 14 are formed of containers and/or pipes that are configured to hold a fluid, such as a liquid (e.g., water, antifreeze mix, high heat capacity liquid, etc.). In some embodiments, the conduits 14 include double-sided microcapillary layers that are embedded in opposite sides 12A, 12B of the rigid foam insulation core 13 of the partition 12. In some embodiments, fiber-reinforced polymer panels cover the double-sided microcapillary layers of the conduits 14. In some embodiments, additional fiber-reinforced polymer panels are disposed between the rigid foam insulation core 13 of the partition 12 and the fiber-reinforced polymer panels that cover the double-sided microcapillary layers of the conduits 14. In some embodiments, the conduits 14 are in the form of a capillary mat, a single pipe, a thin bladder-like container, a polycarbonate sheet, a honeycomb panel, or the like. However, this is not intended to be limiting as the present technology contemplates the conduits 14 being any type of container that is assembled and held close to the surface of the partition 12.

Figure 2A:
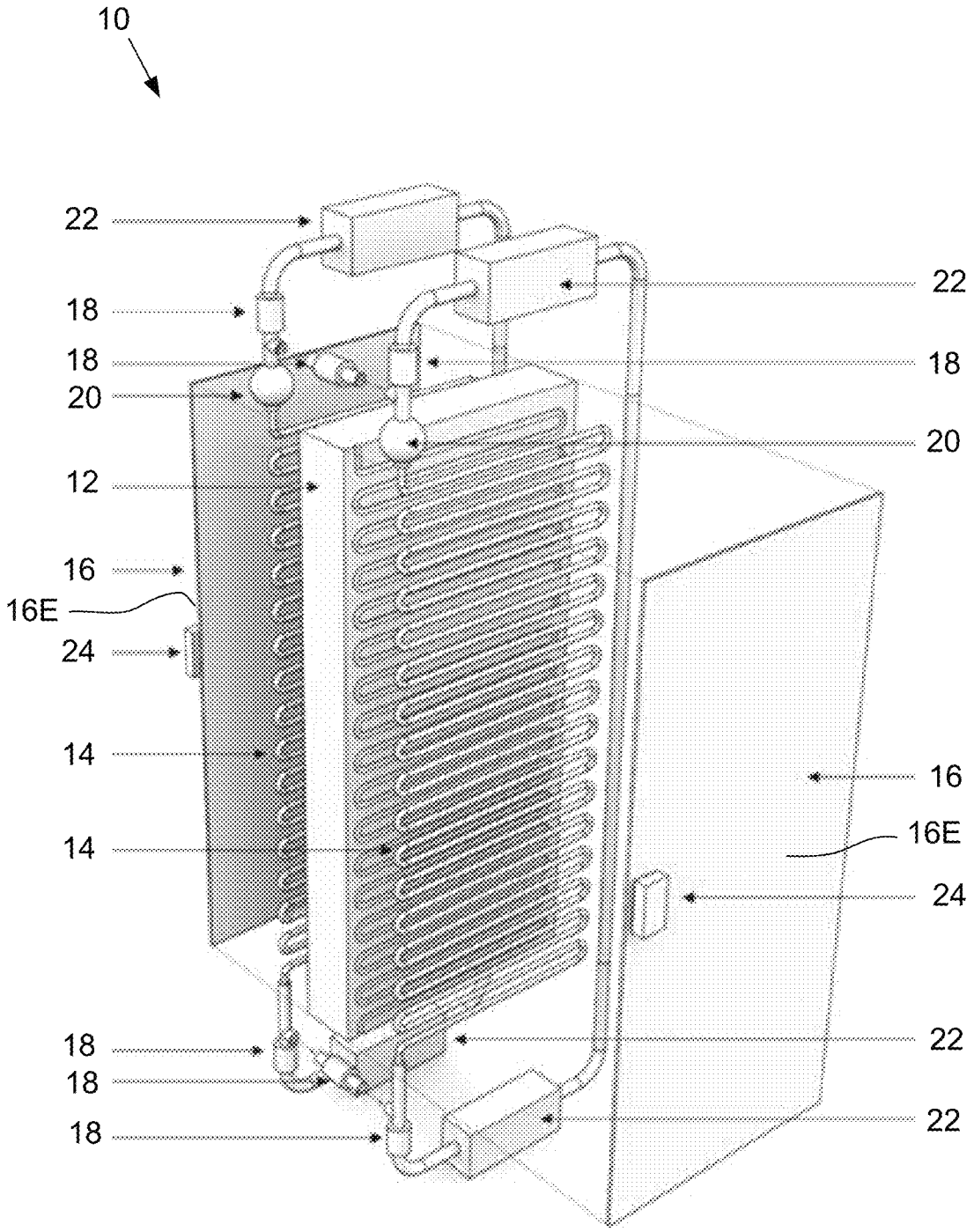
FIG. 2A is an exploded view of a hydronic system according to an embodiment of the present technology.

As shown in FIG. 2A, the hydronic system 10 includes at least one computer-controlled valve 18 that is configured to control the flow of the fluid (e.g., liquid) through different routes within the hydronic system 10. In some embodiments, the hydronic system 10 includes six solenoid valves 18, but the present technology contemplates embodiments using any number, configuration, or type of valve 18. For example, in the embodiment shown in FIG. 2A, the valves 18 are unidirectional valves. In other embodiments, the valves 18 are multi-directional valves (i.e., have more than one direction of fluid flow), which reduces the total number of valves 18 used in the hydronic system 10.

As shown in FIG. 2A, the hydronic system 10 includes at least one pump 20 (also referring to herein as a system pump 20) that is configured to control the flow of the fluid (e.g., liquid) through the hydronic system 10. In some embodiments, the hydronic system 10 includes two pumps 20 (one pump 20 for each conduit 14), but the present technology contemplates embodiments using any number, configuration, or type of pump 20.

As shown in FIG. 2A, at least one of the conduits 14 is connected to an external fluid source 22 that provides hot or cold fluid (e.g., liquid) to the hydronic system 10. In some embodiments, each conduit 14 is connected to a separate external fluid source 22. In some embodiments, each conduit 14 is connected to the same external fluid source 22. In some embodiments, the external fluid source 22 is a liquid heater, a liquid cooler, a solar concentrator, a geothermal cold source, a geothermal hot source, or the like.

As shown in the figures, a first sheet of finishing material 16 covers the first conduit 14, and a second sheet of finishing material 16 covers the second conduit 14. In some embodiments, the sheets of finishing material 16 are formed of a fiber-reinforced polymer ("FRP") material. In some embodiments, the partition 12 is a prefabricated panel (e.g., a structural insulated panel ("SIP")) and the sheets of finishing material 16 are the equivalent of the skin of the SIP. In some embodiments, sheets of finishing material 16 are formed of wood, metal, thermoplastic, thermoset, etc. In some embodiments involving wet construction, the sheets of finishing material 16 are formed of a plaster or other wall finishing material. In some embodiments involving wet construction, the sheets of finishing material 16 are formed of shingles.

In some embodiments, the hydronic system 10 includes at least one heat sensor 24 on opposite sides 12A, 12B of the partition 12. For example, as shown in FIG. 2A, the hydronic system 10 includes a first heat sensor 24 on the exterior face 16E of the first sheet of finishing material 16, and a second heat sensor 24 on the exterior face 16E of the second sheet of finishing material 16. The heat sensors 24 are configured to detect the temperature difference between the opposite sides 12A, 12B of the partition 12 (e.g., the difference in temperature on either side of a wall within a building). In some embodiments, the heat sensors 24 are air and/or water temperature sensors.

In some embodiments, the hydronic system 10 includes a processor (or a computer system) that is connected to the heat sensors 24, the valves 18, and the pumps 20. In some embodiments, the processor calculates the temperature difference between the two sides 12A, 12B of the partition 12 using input from the heat sensors 24, and the processor sends a signal to the valves 18 and the pumps 20 to configure the flow of the fluid within the hydronic system 10. In some embodiments, the hydronic system 10 operates between two modes: a heat exchange mode and an isolating (e.g., insulating) mode. In some embodiments, the processor evaluates (e.g., at a constant rate) the temperatures on both sides 12A, 12B of the partition 12 and decides whether to operate the hydronic system 10 according to the heat exchange mode or the isolating mode. In some embodiments, depending on the amount of hot or cold fluid available from the external fluid sources 22, the processor chooses the most energy-efficient external fluid source 22 to achieve the predetermined ideal temperatures in the interiors of the building.

Figure 11A:
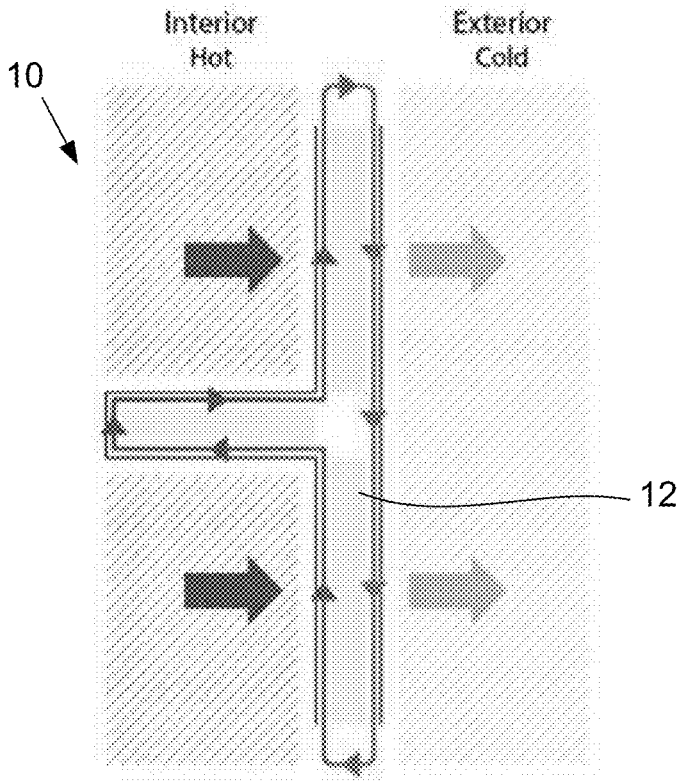
FIG. 11A is a schematic view of a hydronic system according to an embodiment of the present technology operating in a heat exchange mode.
Figure 11B:
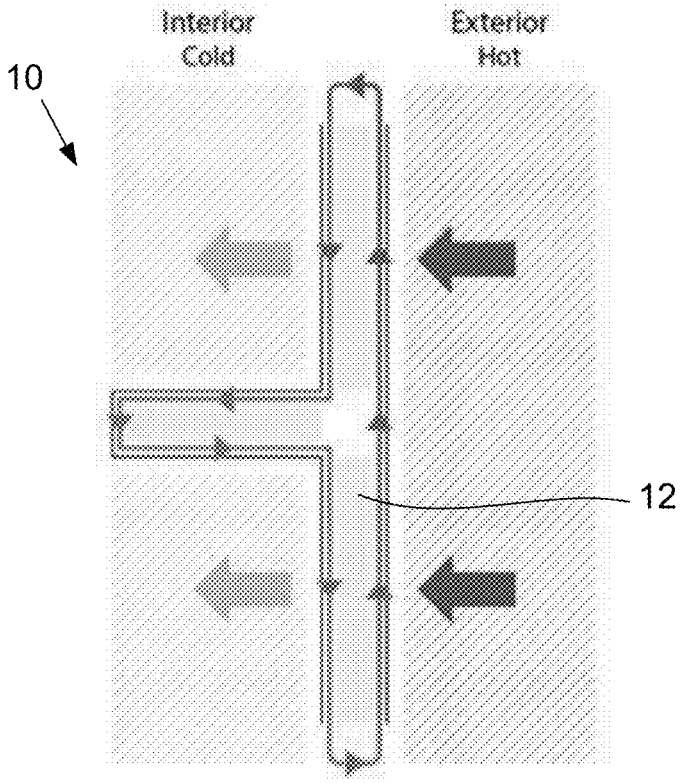
FIG. 11B is a schematic view of a hydronic system according to an embodiment of the present technology operating in a heat exchange mode.

FIGS. 11A-11B show an exemplary hydronic system 10 operating in the heat exchange mode. The heat exchange mode is used when the temperature on one side of the partition 12 is not desirable (i.e., more or less than ideal) and the temperature on the other side is closer to the ideal. In such embodiments, the valves 18 and pumps 20 are operated such that the fluid flows through the conduits 14 between the two sides 12A, 12B of the partition 12, thus allowing heat exchange to occur between the two sides until a desirable temperature on one of the two sides is reached.

One example of the heat exchange mode is shown in FIG. 11A, which shows an embodiment in which the partition 12 forms part of an exterior wall of a building and the interior side of the building is hotter than ideal while the exterior side is closer to ideal (i.e., colder). In this embodiment, the valves 18 and pumps 20 are operated such that the fluid moves through the conduits 14 from the interior to the exterior in a closed loop until the interior temperature equalizes with the exterior temperature or until the interior temperature reaches an ideal.

Another example of the heat exchange mode is shown in FIG. 11B, which shows an embodiment in which the interior is colder than ideal, and the exterior is closer to ideal (i.e., hotter). In this embodiment, the same flow of fluid through the conduits 14 as in FIG. 11A is achieved by operation of the pumps 20 and valves 18 to allow heat to come into the interior of the building until the interior temperature equalizes with the exterior temperature or until the interior temperature reaches an ideal.

Figure 12A:
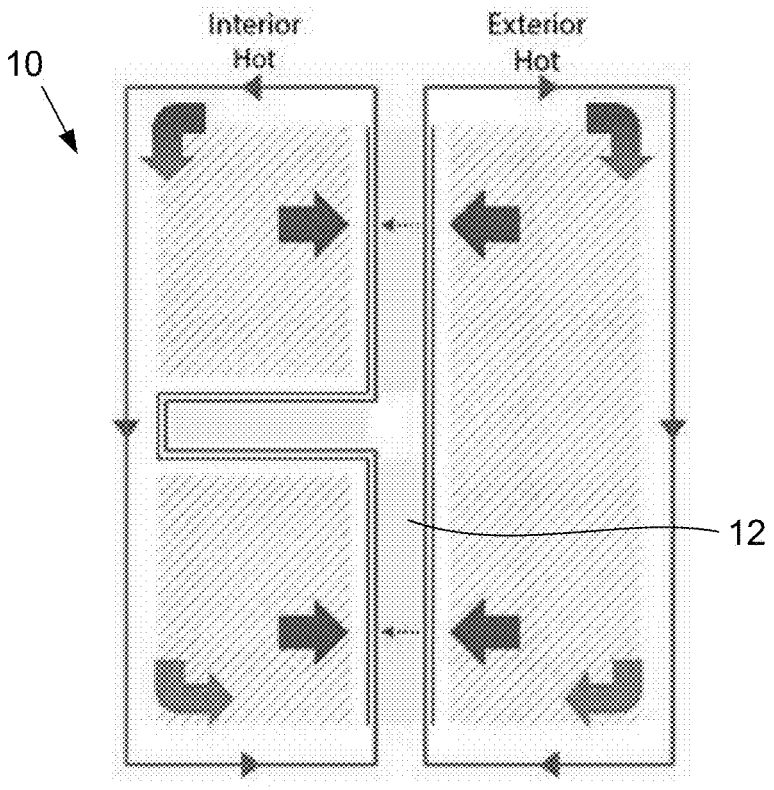
FIG. 12A is a schematic view of a hydronic system according to an embodiment of the present technology operating in an isolating mode.
Figure 12B:
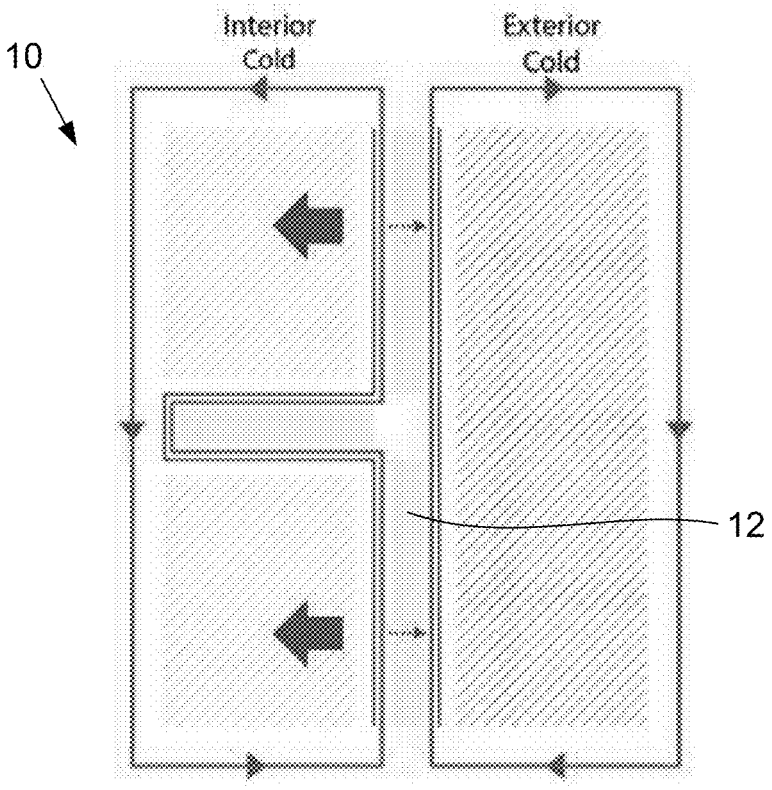
FIG. 12B is a schematic view of a hydronic system according to an embodiment of the present technology operating in an isolating mode.

FIGS. 12A-12B show an exemplary hydronic system 10 operating in the isolating mode. The hydronic system 10 runs in the isolating mode when the temperature on either side of the building is not desirable. In such embodiments, the valves 18 and pumps 20 are operated such that fluid flows through the conduit 14 on the interior side of the partition 12 in a closed loop and fluid flows through the conduit 14 on the exterior side of the partition 12 in another closed loop. The isolating mode prevents heat exchange through the partition 12 from occurring (i.e., the isolating mode prevents heat exchange between the two sides 12A, 12B of the partition 12).

One example of the isolating mode is shown in FIG. 12A, which shows the embodiment in which the partition 12 forms part of an exterior wall of a building and the interior side of the building is hotter than ideal while the exterior side is even hotter. In this embodiment, the valves 18 and pumps 20 are operated such that fluid flows independently in the conduit 14 on the interior side of the partition 12 and fluid flows independently in the conduit 14 on the exterior side of the partition 12 (i.e., fluid flows in a closed loop on the interior side of the wall and the fluid flows in another closed loop on the exterior side of the wall.) This prevents, delays, limits heat exchange from occurring between the interior and the exterior by effectively increasing the insulation value of the partition 12.

In some embodiments, the hydronic system 10 is part of a hydronic network (as discussed in detail below) that is connected to a source of cold water. In those embodiments, liquid in at least one of the conduits 14 (i.e., liquid in the loop on the interior of the wall or liquid in the loop on the exterior of the wall) flows through or from the source of cold water. In one example, flow through the cold source is from the conduit 14 on the interior of the partition 12 (i.e., the interior layer or the interior loop), and heat is removed from the interior, thus cooling the space.

Another example of the insulating mode is shown in FIG. 12B, which shows the embodiment in which the interior of the partition 12 is colder than ideal and the exterior is even colder. In this embodiment, the valves 18 and pumps 20 are operated such that fluid flows independently in the conduit 14 on the interior side of the partition 12 and fluid flows independently in the conduit 14 on the exterior side of the partition 12 (i.e., fluid on the interior side of the partition 12 flows in a closed loop, and fluid on the exterior side of the partition 12 flows in another closed loop.) This operation prevents, delays, limits heat exchange from occurring between the interior and the exterior by effectively increasing the insulation value of the partition 12.

In some embodiments, the hydronic system 10 is part of a hydronic network (as discussed in detail below) that is connected to a source of hot water. In those embodiments, liquid in at least one of the two conduits 14 (i.e., the liquid in the loop on the interior of the wall or the liquid in the loop on the exterior of the wall) flows through or from the source of hot water. In one example, flow from the hot water source occurs through the conduit 14 on the interior of the partition 12 (i.e., the interior layer or the interior loop), and heat is released into the interior, thus heating the space. Although in FIGS. 11A-12B the hydronic system 10 is shown as encompassing a wall and a floor, in some embodiments the hydronic system 10 only covers a single wall. In other embodiments, the hydronic system 10 covers additional walls, floors, or other opaque surfaces. In some embodiments, multiple hydronic system 10 are connected over multiple opaque surfaces to form a hydronic network, as discussed in detail below.

Figure 2B:
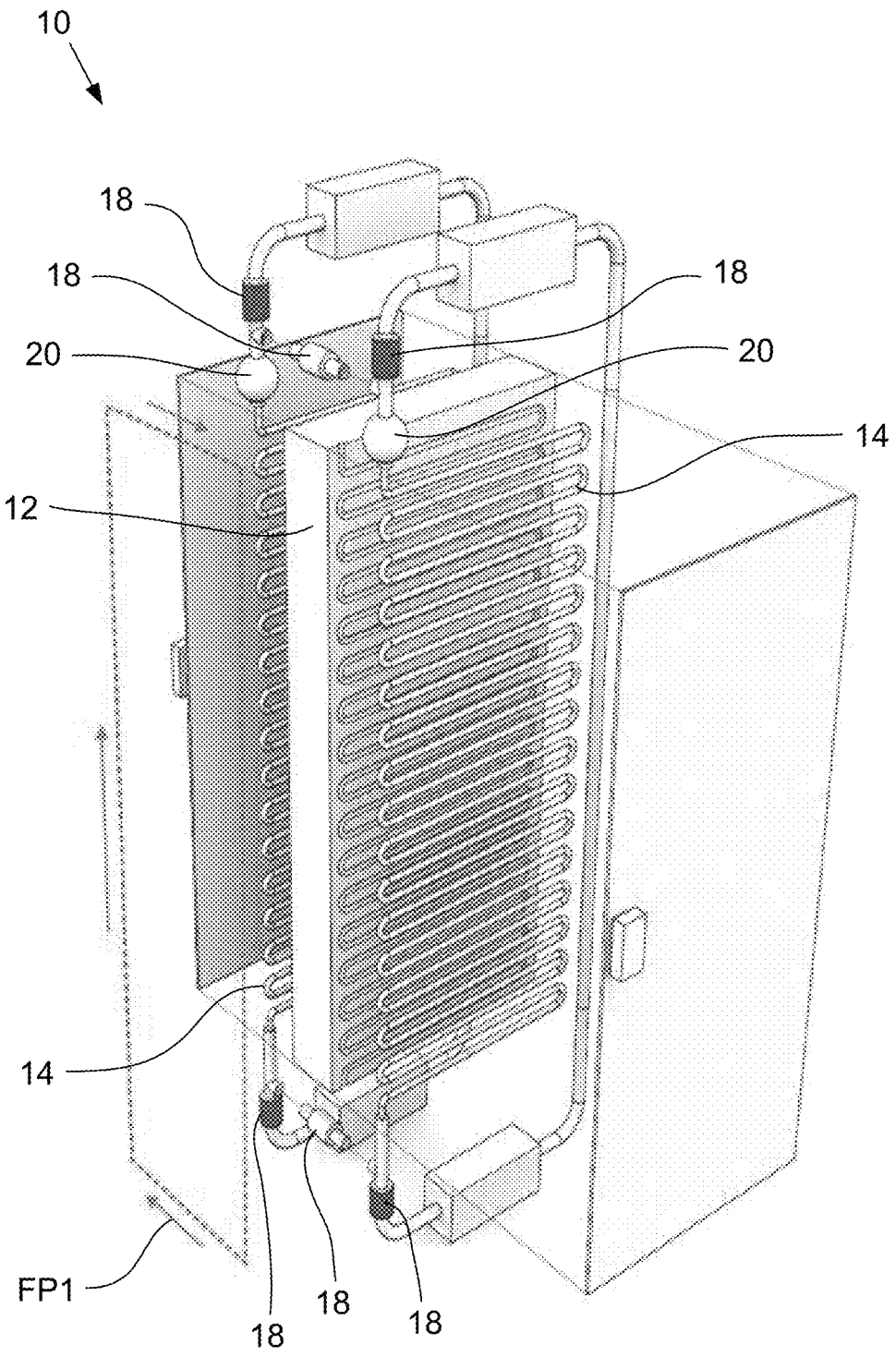
FIG. 2B is an exploded view of a hydronic system of FIG. 2A operating in a heat exchange mode.

FIG. 2B shows the hydronic system 10 of FIG. 2A operating in the heat exchange mode. The vertically oriented valves 18 (i.e., the darkened valves) in FIG. 2B are closed, and the horizontally oriented valves 18 (i.e., the undarkened valves) in FIG. 2B are open, and at least one of the pumps 20 is operating. With this valve configuration, the conduits 14 are in fluid communication with each other such that the fluid circulates through each conduit 14 on both sides 12A, 12B of the partition 12, as indicated by the flow path FP1. Thus, heat exchange through the partition 12 is facilitated or promoted.

Figure 2C:
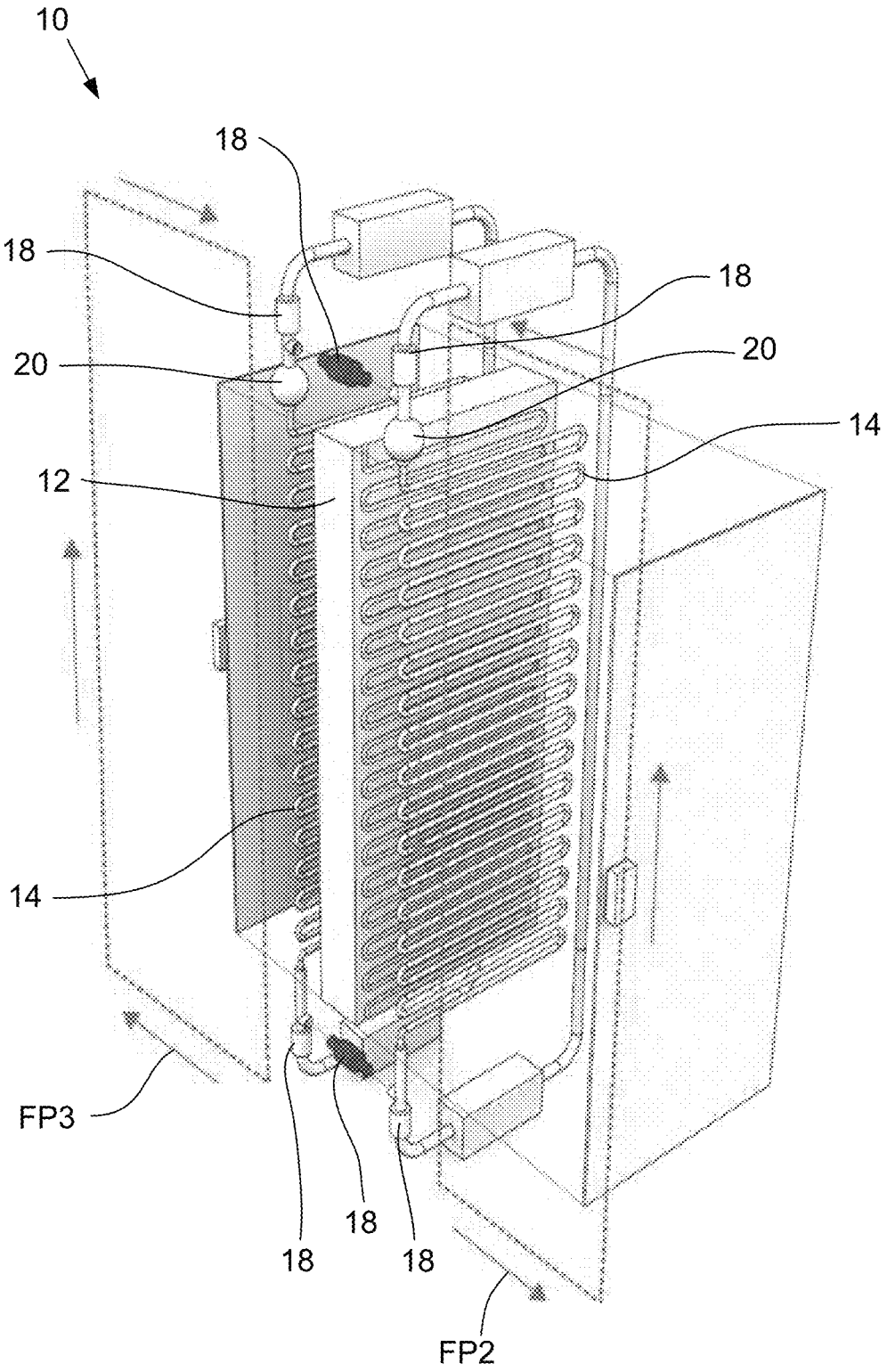
FIG. 2C is an exploded view of a hydronic system of FIG. 2A operating in an isolating mode.

FIG. 2C shows the hydronic system 10 of FIG. 2A operating in the isolating mode. The horizontally oriented valves 18 (i.e., the darkened valves) in FIG. 2C are closed, the vertically oriented valves 18 (i.e., the undarkened valves) in FIG. 2C are open, and the pumps 20 are operating. With this valve configuration, the conduits 14 are not in fluid communication with each other such that the fluid does not flow between the conduits 14. Rather, the fluid circulates within the first conduit 14 on the first side 12A of the partition 12 in a first closed loop, as indicated by the flow path FP2, and the fluid circulated within the second conduit 14 on the second side 12B of the partition 12 in a second closed loop, as indicated by the flow path FP3. Thus, heat exchange through the partition 12 is reduced or limited.

Figure 3:
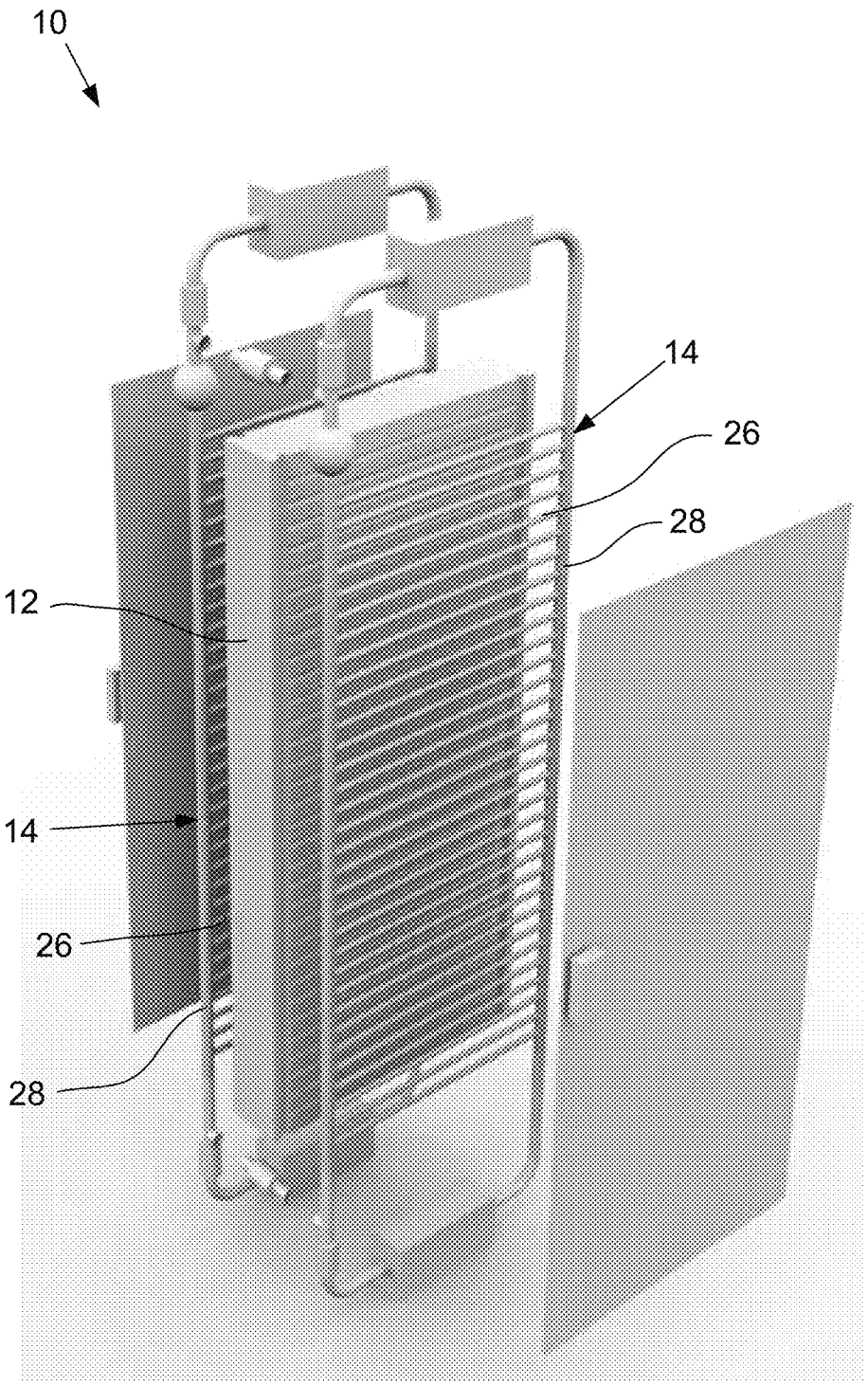
FIG. 3 is an exploded view of a hydronic system according to an embodiment of the present technology.

Referring to FIG. 3, another embodiment of the hydronic system 10 is provided. The embodiment shown in FIG. 3 is similar to that of FIG. 2A except that the conduits 14 are in a different form. In the embodiment shown in FIG. 3, the conduits 14 are parallel microcapillaries (e.g., a capillary mat). The conduits 14 include a plurality of thin pipes 26 that extend parallel to each other. The plurality of thin pipes 26 connect with two thicker pipes 28 extending perpendicular to the thin pipes. In the embodiment shown in FIG. 3, the plurality of thin pipes 26 are horizontally oriented and the two thicker pipes 28 are vertically oriented. In some embodiments, the plurality of thin pipes 26 are vertically oriented and the two thicker pipes 28 are horizontally oriented, as shown in FIG. 1.

Figure 4:
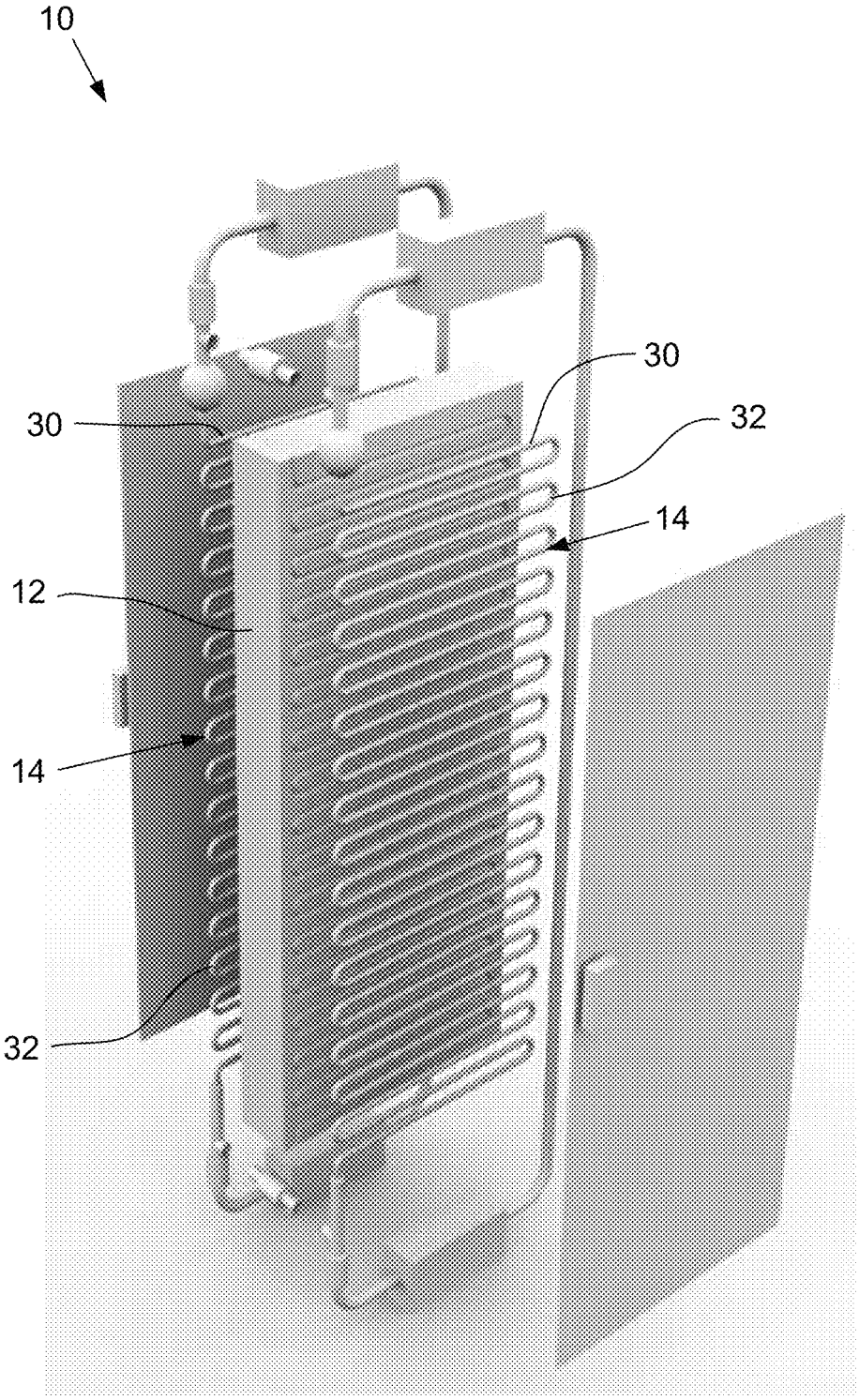
FIG. 4 is an exploded view of a hydronic system according to an embodiment of the present technology.

Referring to FIG. 4, another embodiment of the hydronic system 10 is provided. The embodiment shown in FIG. 4 is similar to that of FIG. 2A except that the conduits 14 are in a different form. In the embodiment shown in FIG. 4, the conduits 14 are each one continuous pipe 30. The pipe 30 extends in a first direction, bends 180 degrees at a U-bend 32, extends in a second direction parallel to the first direction, bends 180 degrees at another U-bend 32, extends in the first direction, and so on.

Figure 5:
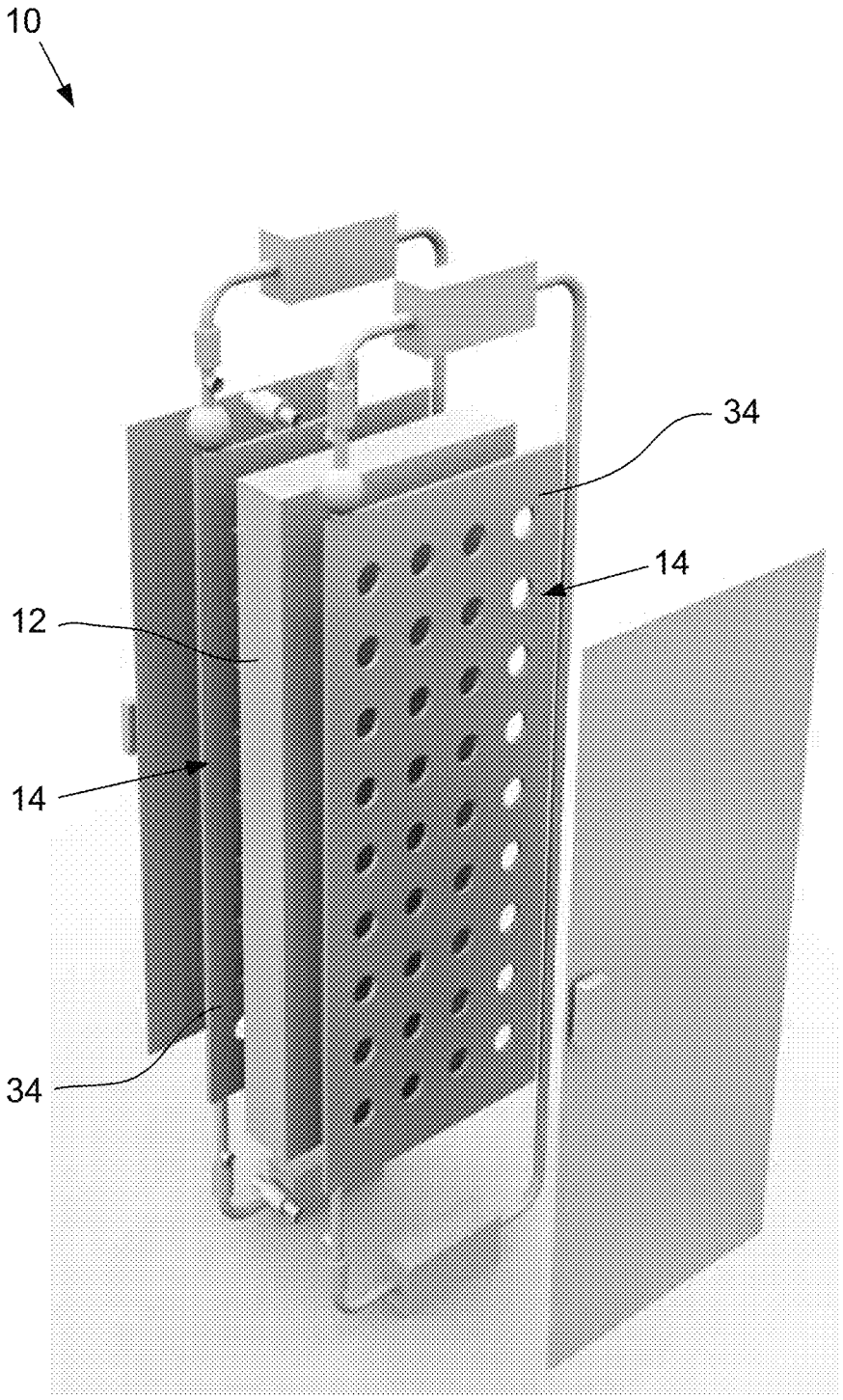
FIG. 5 is an exploded view of a hydronic system according to an embodiment of the present technology.

Referring to FIG. 5, another embodiment of the hydronic system 10 is provided. The embodiment shown in FIG. 5 is similar to that of FIG. 2A except that the conduits 14 are in a different form. In the embodiment shown in FIG. 5, the conduits 14 include a thin container 34, such as a rigid bladder.

Figure 6:
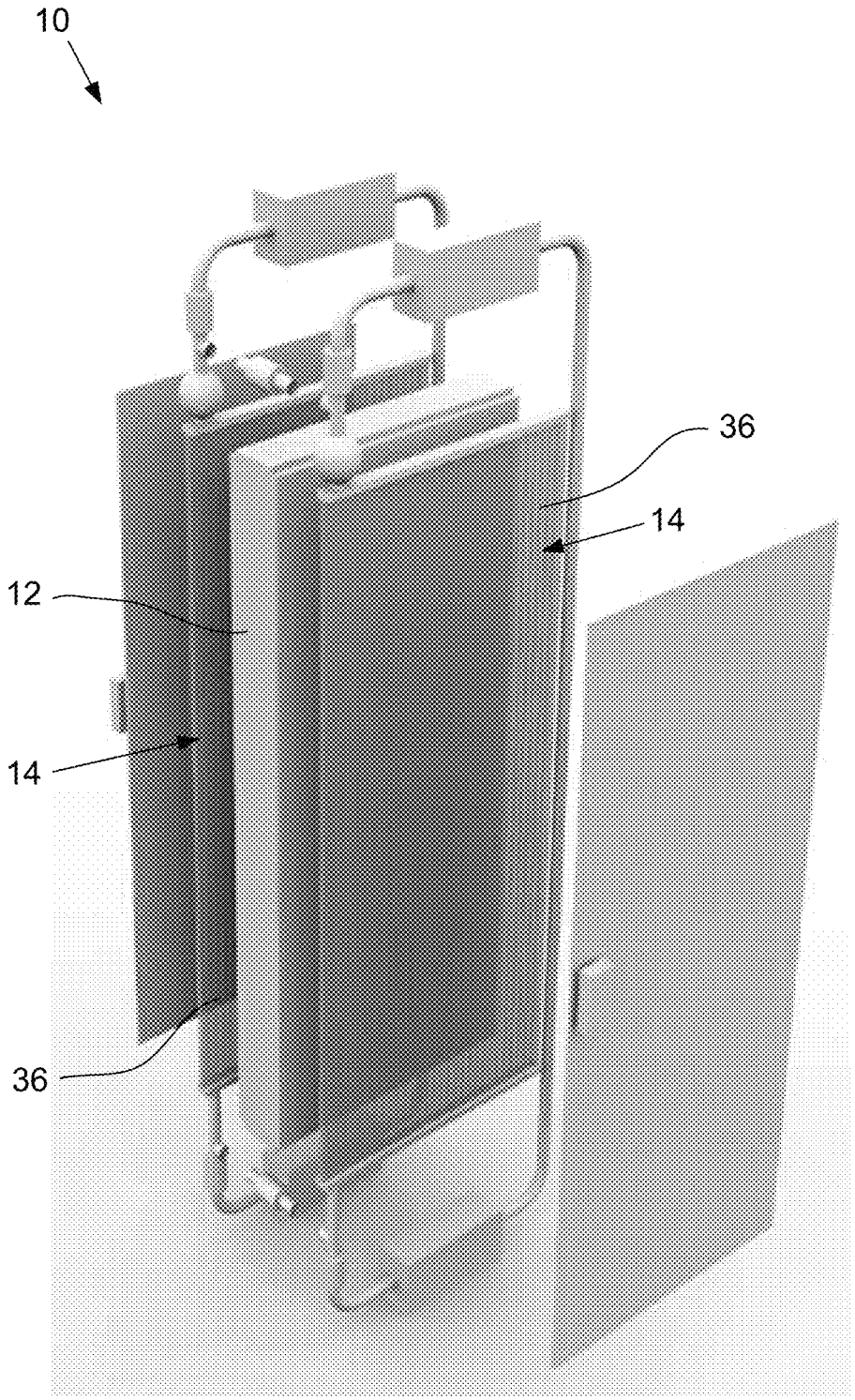
FIG. 6 is an exploded view of a hydronic system according to an embodiment of the present technology.

Referring to FIG. 6, another embodiment of the hydronic system 10 is provided. The embodiment shown in FIG. 6 is similar to that of FIG. 2A except that the conduits 14 are in a different form. In the embodiment shown in FIG. 6, the conduits 14 include polycarbonate sheets 36, in which the fluid flows within channels of the polycarbonate sheets.

Figure 7:
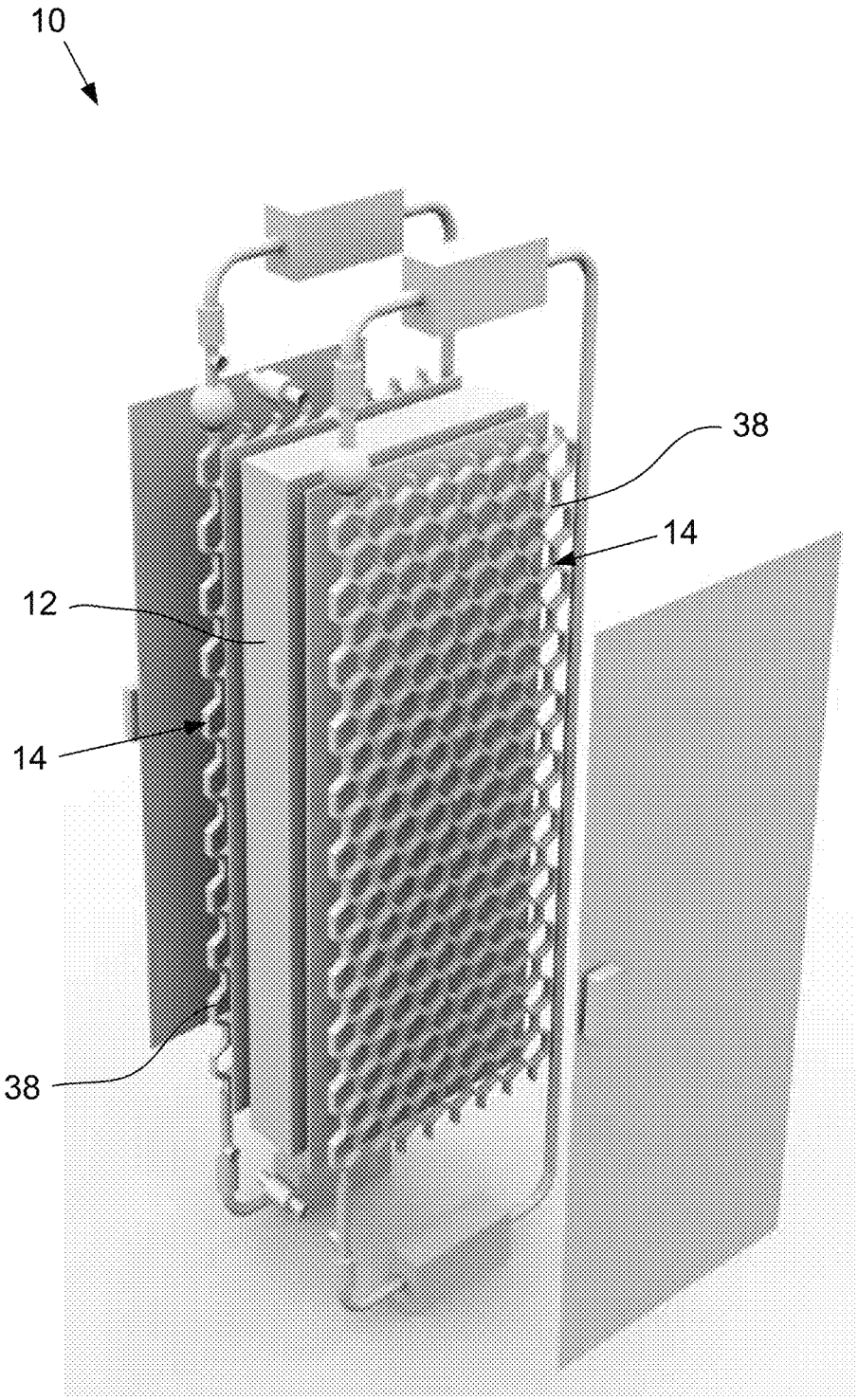
FIG. 7 is an exploded view of a hydronic system according to an embodiment of the present technology.

Referring to FIG. 7, another embodiment of the hydronic system 10 is provided. The embodiment shown in FIG. 7 is similar to that of FIG. 2A except that the conduits 14 are in a different form. In the embodiment shown in FIG. 7, the conduits 14 include a plurality of pipes 38 that are interconnected in a honeycomb configuration. The fluid flows through the honeycomb-configured pipes 38.

The hydronic system 10 discussed herein can be provided as a prefabricated construction unit or added in wet construction. In the case of the prefabricated unit, in some embodiments, the partition 12 is an SIP panel that is embedded with the conduits 14 and encapsulated with the sheets of finishing material 16 (e.g., skin) to become a complete plug-and-play system. In some embodiments, the valves 18 and pumps 20 are embedded in the partition 12. In other embodiments, the valves 18 and pumps 20 are added on the construction site as separate elements during construction. In the case of wet construction, the conduits 14, valves 18, pumps 20, etc., are embedded within construction systems and finished with the sheets of finishing material 16 (e.g., a plaster-like material).

The hydronic system 10 discussed herein can be provided as an exterior wall, a floor/ceiling, an interior partition, a roof, or any combination thereof. When the hydronic system 10 is provided as an exterior wall or roof, the hydronic system 10 controls the exchange of heat between the inside and outside of the building. When the hydronic system 10 is provided as an interior partition, the hydronic system 10 controls the exchange of heat between two rooms that are on opposite side of the partition 12. When the hydronic system 10 is provided as a floor/ceiling, the hydronic system 10 controls heat exchange between the two building floors on opposite sides of the partition 12.

In some embodiments, the hydronic system 10 takes the form of an opaque building surface. The opaque building surface can be of any size. In some embodiments, multiple hydronic systems 10 are combined to form a hydronic network, as discussed in detail below. The hydronic network includes additional valves 18 and/or pumps 20 that enable more complex heat exchange from any part of the building to any other part of the building. In some embodiments, the hydronic network partially covers a building. In other embodiments, the hydronic network entirely covers a building.

Figure 8:
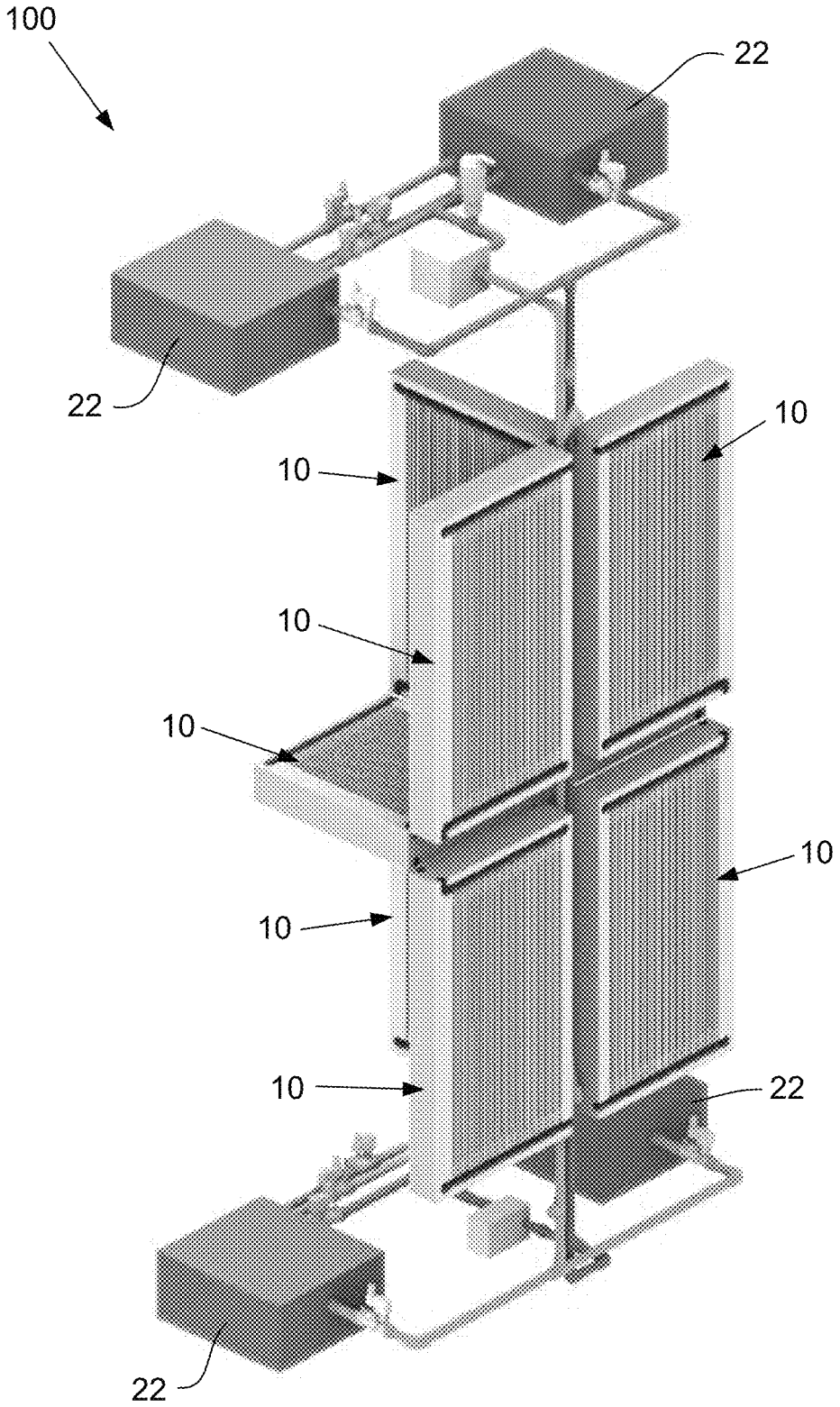
FIG. 8 is a schematic view of a hydronic network according to an embodiment of the present technology.
Figure 9:
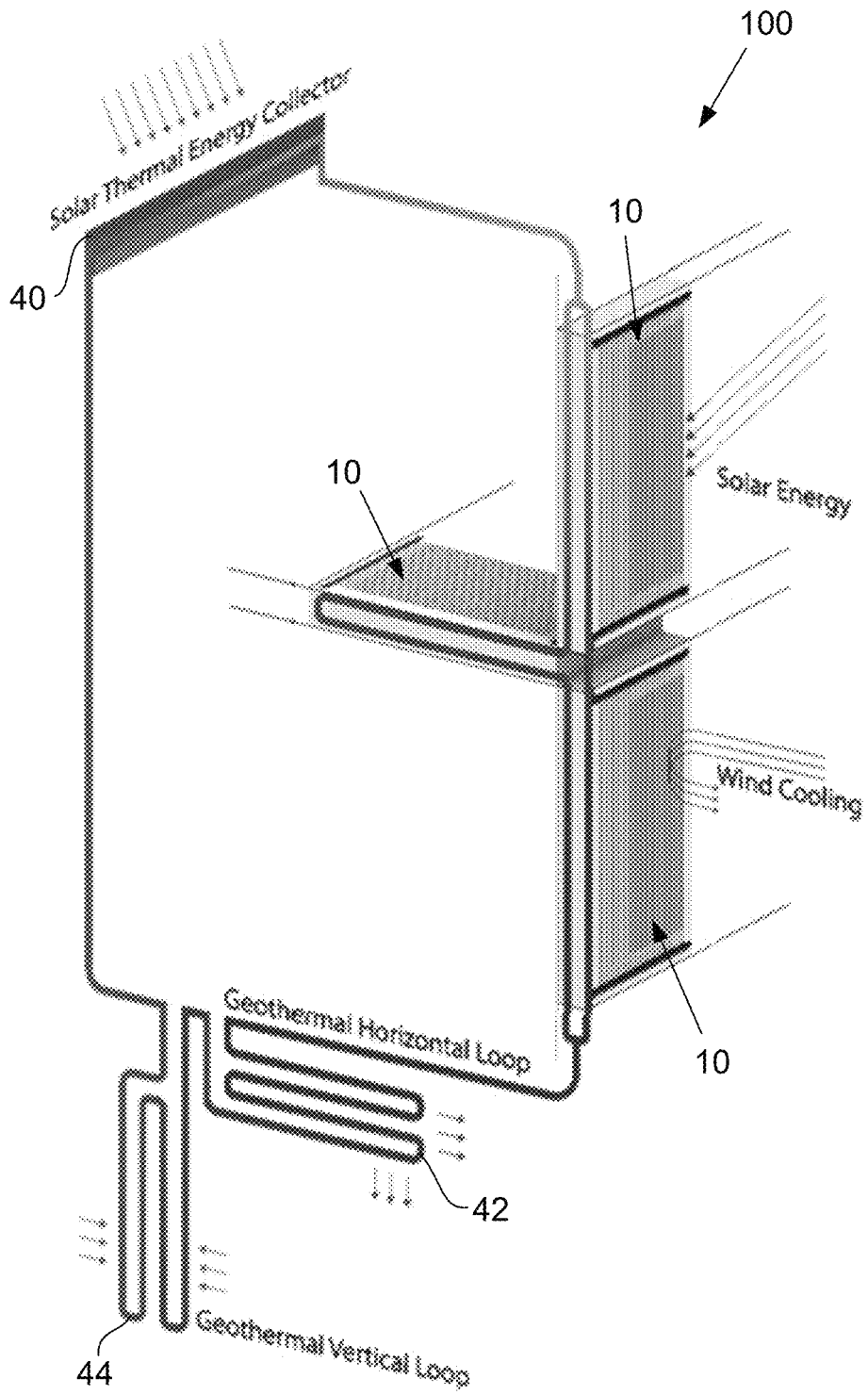
FIG. 9 is a schematic view of a hydronic network according to an embodiment of the present technology.
Figure 10:
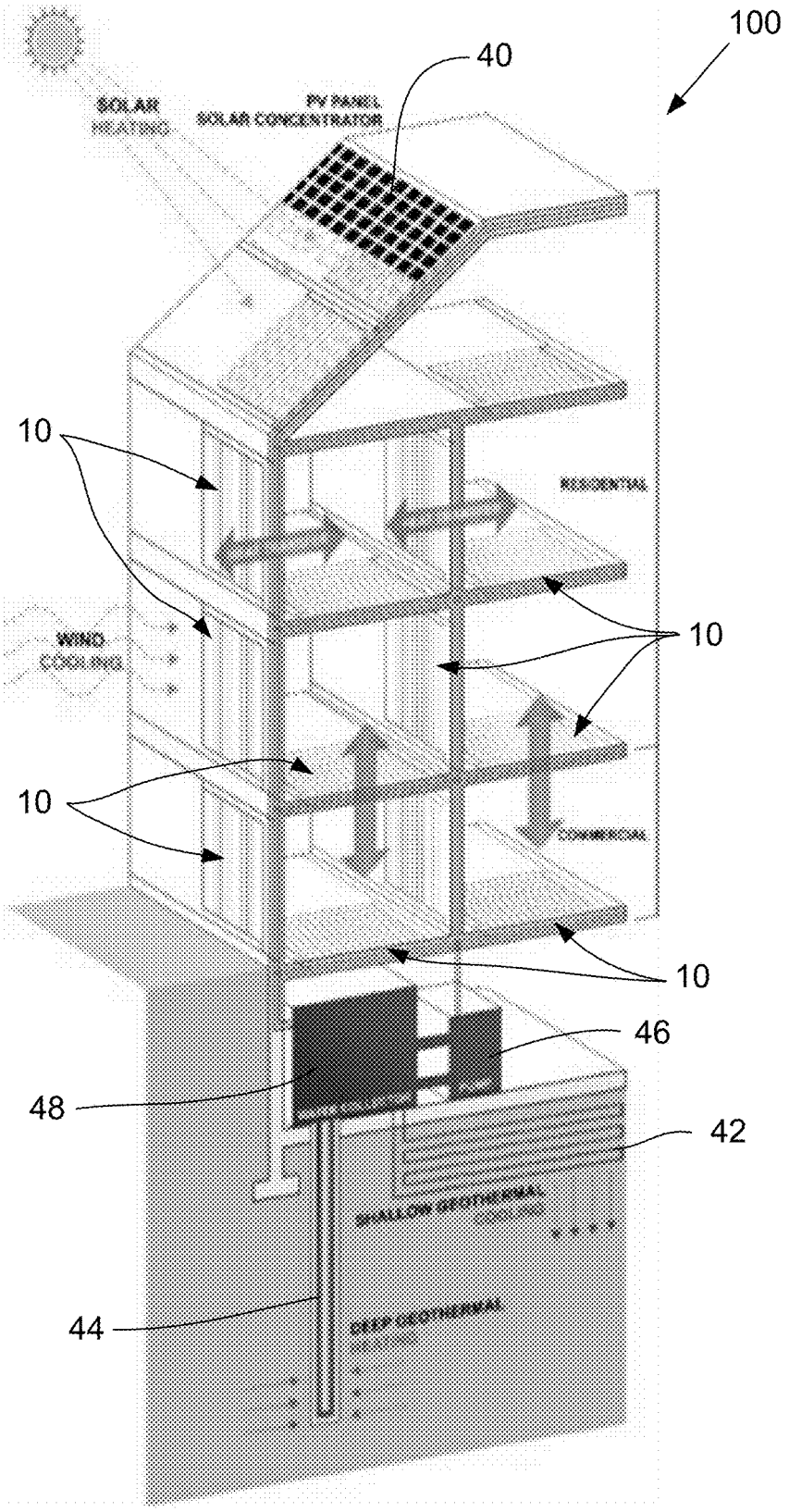
FIG. 10 is a schematic view of a hydronic network according to an embodiment of the present technology.

As shown in FIGS. 8-10, a hydronic network is generally designated by the numeral 100. The hydronic network 100 is configured to control the temperature within the rooms of a building. The hydronic network 100 includes a plurality of the hydronic systems 10 discussed herein. Each of the plurality of the hydronic systems 10 is integrated into a floor, a ceiling, or a wall of the building. For example, in the embodiment shown in FIG. 8, eight hydronic systems 10 are combined to form a hydronic network 100. In an exemplary embodiment, two of the hydronic systems 10 form part of an exterior wall of a first story of a building; one of the hydronic systems 10 forms part of an interior wall of the first story of the building; two of the hydronic systems 10 form part of a ceiling of the first story and a floor of a second story of the building; two of the hydronic systems 10 form part of an exterior wall of the second story of the building; and one of the hydronic systems 10 forms part of an interior wall of the second story of the building. Many other configurations are possible, even with the same arrangement of hydronic systems 10 shown in FIG. 8. Other arrangements of the hydronic network 100 enable some or all of the interior and exteriors walls, floors, ceilings, and roof of a building to be made up of the hydronic systems 10. The processor monitors temperatures at various locations inside the building to determine where to route the fluid flowing within the hydronic network 100.

In some embodiments, the hydronic network 100 uses geothermal energy, solar energy, and/or wind cooling. For example, FIG. 9 shows an embodiment of the present technology where three hydronic systems 10 are integrated into a building to form a hydronic network 100. One hydronic network 10 forms part of a wall of one story of the building; one hydronic network 10 forms part of a ceiling of that story and a floor of another story of the building; and one hydronic network 10 forms part of a wall of the other story. On the roof, there is a solar thermal energy collector 40 (e.g., a solar concentrator formed of a plurality of photovoltaic panels) that collects solar energy and heats the fluid (e.g., a liquid) within the hydronic network 100. In some embodiments, solar energy is also absorbed through the conduits 14 located within the exterior walls. In some embodiments, wind cools the conduits 14 located within the exterior walls. A pipe leading out of the hydronic systems 10 enters the ground where it forms a geothermal horizontal loop 42. In the geothermal horizontal loop 42, the fluid in the pipe is cooled. A pipe (e.g., the same pipe or a different pipe) also descends into a geothermal vertical loop 44, where geothermal energy heats up the fluid in the pipe. The processor monitors temperature at various locations inside the building to determine where to route the fluid in the hydronic network 100 to optimize use of the heat exchange from the solar thermal energy collector 40, solar energy received through the conduits 14 in the exterior wall, wind cooling taking heat from the conduits 14 in the exterior wall, the geothermal horizontal loop 42, and the geothermal vertical loop 44.

FIG. 10 shows an exemplary embodiment of the hydronic network 100 integrated into a multistory building (e.g., a residential or commercial building). To form the hydronic network 100, the hydronic systems 10 are integrated into some or all the opaque walls, floors, or ceilings in the building. A pump 46 (also referred to herein as a network pump) pumps a fluid (e.g., a liquid) through the hydronic network 100. In some embodiments, solar energy is collected through a solar thermal energy collector 40 (e.g., a solar concentrator formed of a plurality of photovoltaic panels) on the roof. The fluid flows through the conduits 14 in the walls, ceilings, and floors under control of the processor. The processor controls the flow of the fluid by controlling the valves 18, the system pumps 20, and the network pump 46 of the hydronic network 100. The processor uses input in the form of temperature data received from the heat sensors 24 of the hydronic systems 10 to determine which system pumps 20 to activate or deactivate and to determine which valves 18 to open or close. The conduits 14 located in the exterior walls of the building are subject to wind cooling. Heat transfer occurs through all walls and ceilings for which there is a temperature difference on opposite sides. The processor controls where the fluid flows to tune (i.e., adjust or optimize) the insulation values of each of the walls, ceilings, and floors. In some embodiments, after the fluid has moved through the building, it is collected in a fluid collector 48 (e.g., a water collector in embodiments where the fluid is water). In some embodiments, the fluid is sent from the fluid collector 48 through a deep vertical geothermal loop 44 where geothermal energy heats the fluid. The heated fluid then returns to the fluid collector 48. In some embodiments, the fluid is sent from the fluid collector 48 through a shallow horizontal geothermal loop 42 where the fluid is cooled by losing heat to the ground. The cooled fluid then returns to the fluid collector 48. The fluid collector 48 is in fluid communication with the network pump 46. The fluid is sent from the fluid collector 48 to the network pump 46 to be recirculated through the hydronic network 100. Because of the various valves 18, system pumps 20, and conduits 14 in the hydronic network 100, the fluid can be sent from any part of the building to any other part of the building for heat exchange purposes. The processor of the hydronic network 100 controls the temperature in each room by heat exchange (as indicated by the heat transfer arrows between the wall, floors, and ceilings of the building), by tuning (i.e., adjusting or optimizing) the effective insulation value of each wall, floor, and ceiling, and by making use of the available heat sources and heat sinks.

EXAMPLES

In an exemplary embodiment, a hydronic system 10 having an partition 12 with an insulation core 13 formed of a rigid foam material, conduits 14 formed of microcapillary channels, and sheets of finishing material 16 formed of fiber-reinforced polymer ("FRP") panels was operated under two isolating mode and one heat exchange mode scenarios to examine the energy benefits achieved by the hydronic system 10 for various climate conditions. Table 1 below shows the dimensions and material properties of the exemplary hydronic system 10 and the microcapillary channels of the conduits 14. Table 2 below shows the material properties of the other layers of the hydronic system 10.

TABLE 1

Characteristics of the hydronic system

| Part | Value |
|---|---|
| Panel width | 600 mm (23.62 in) |
| Panel height | 900 mm (35.43 in) |
| Panel thickness | 102 mm (4 in) |
| Microcapillary inner diameter | 6.4 mm (0.25 in) |
| Microcapillary outer diameter | 9.6 mm (0.38 in) |
| Microcapillary channel length | 600 mm (23.62 in) |
| Spacing between channels | 15 mm (0.59 in) |
| Total number of a single channel | 36 ea |
| Thermal conductivity of the channel material | 0.6 W/Mk (0.35 Btu/hr · ft ° F.) |

TABLE 2

Material properties of the hydronic system

| | FRP panel | Insulation foam |
|---|---|---|
| Thickness (mm [in]) | 2 (0.08) | 86 (3.38) |
| Thermal conductivity (W/Mk [0.35 Btu/hr · ft ° F.]) | 0.35 (0.20) | 0.035 (0.02) |
| Specific heat capacity (J/kgK [Btu/lb ° F.]) | 1200 (0.286) | 1500 (0.358) |
| Density (kg/m$^3$ [lb/ft$^3$]) | 1600 (99.88) | 45 (2.80) |

Figure 13A:
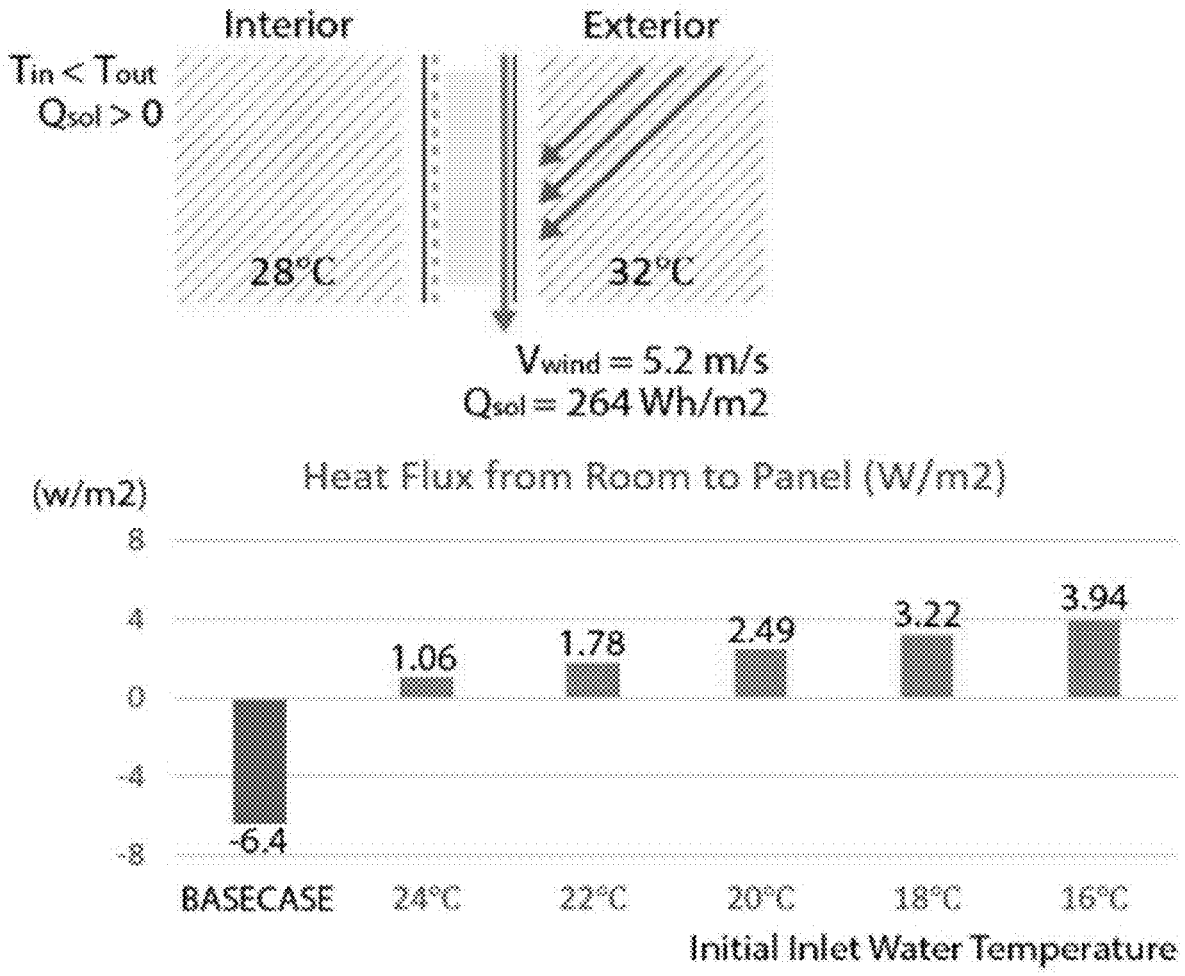
FIG. 13A is a chart showing the results of a hydronic system according to an embodiment of the present technology operating in an isolating mode.

FIG. 13A shows the results for the first scenario having the hydronic system 10 operating in the isolating mode for cooling. The indoor temperature $T_{in}$ is 28° C. (82.4° F.), the outdoor temperature $T_{out}$ is 32° C. (89.6° F.), and the solar incident on the exterior surface is 264 Wh/m$^2$ (83.69 Btu/ft2 hr). Therefore, the isolating mode for cooling is required to reduce the heat flux from the panel to the room.

Figure 13B:
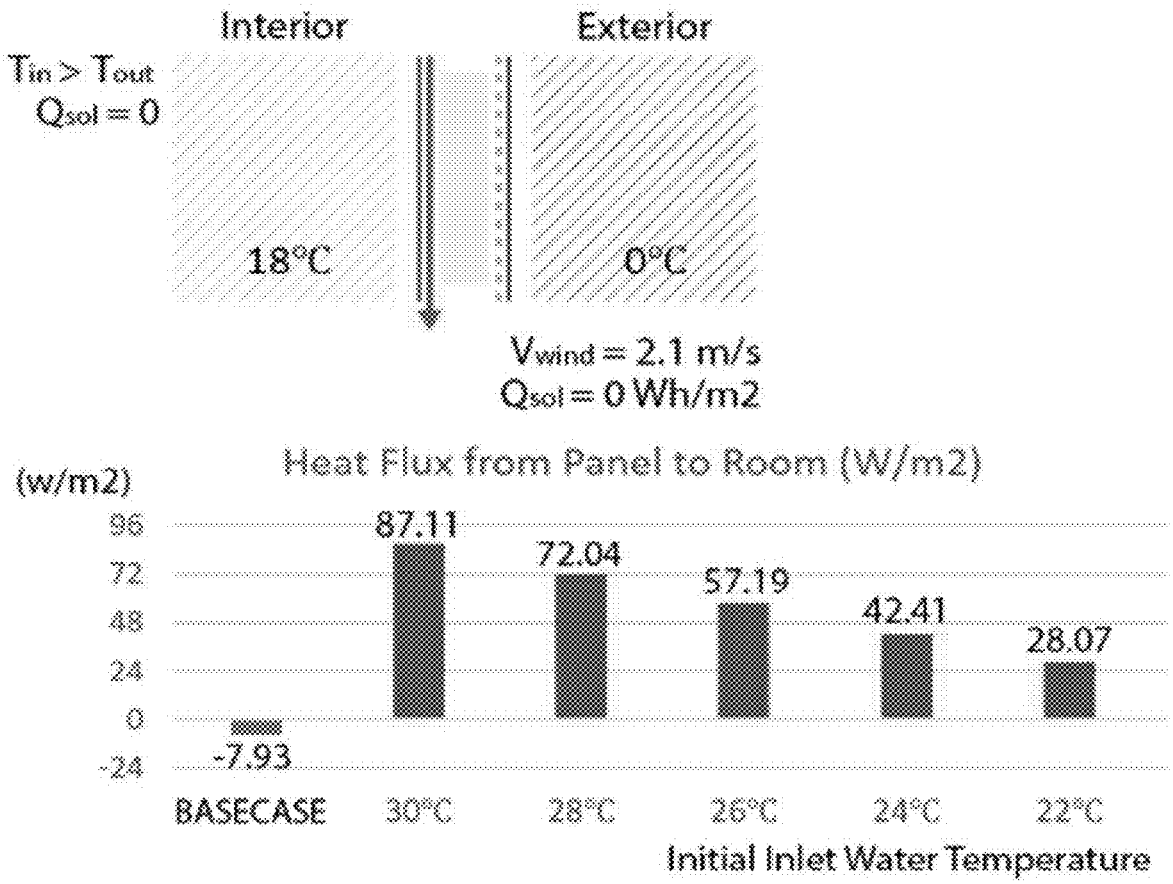
FIG. 13B is a chart showing the results of a hydronic system according to an embodiment of the present technology operating in an isolating mode.

FIG. 13B shows the results for the second scenario having the hydronic system 10 operating in the isolating mode for heating. $T_{in}$ is 18° C. (64.4° F.) and $T_{out}$ is 0° C. (32° F.) without solar incident on the surface. Therefore, the isolating mode for heating is required to increase the heat flux from the panel to the room.

Figure 13C:
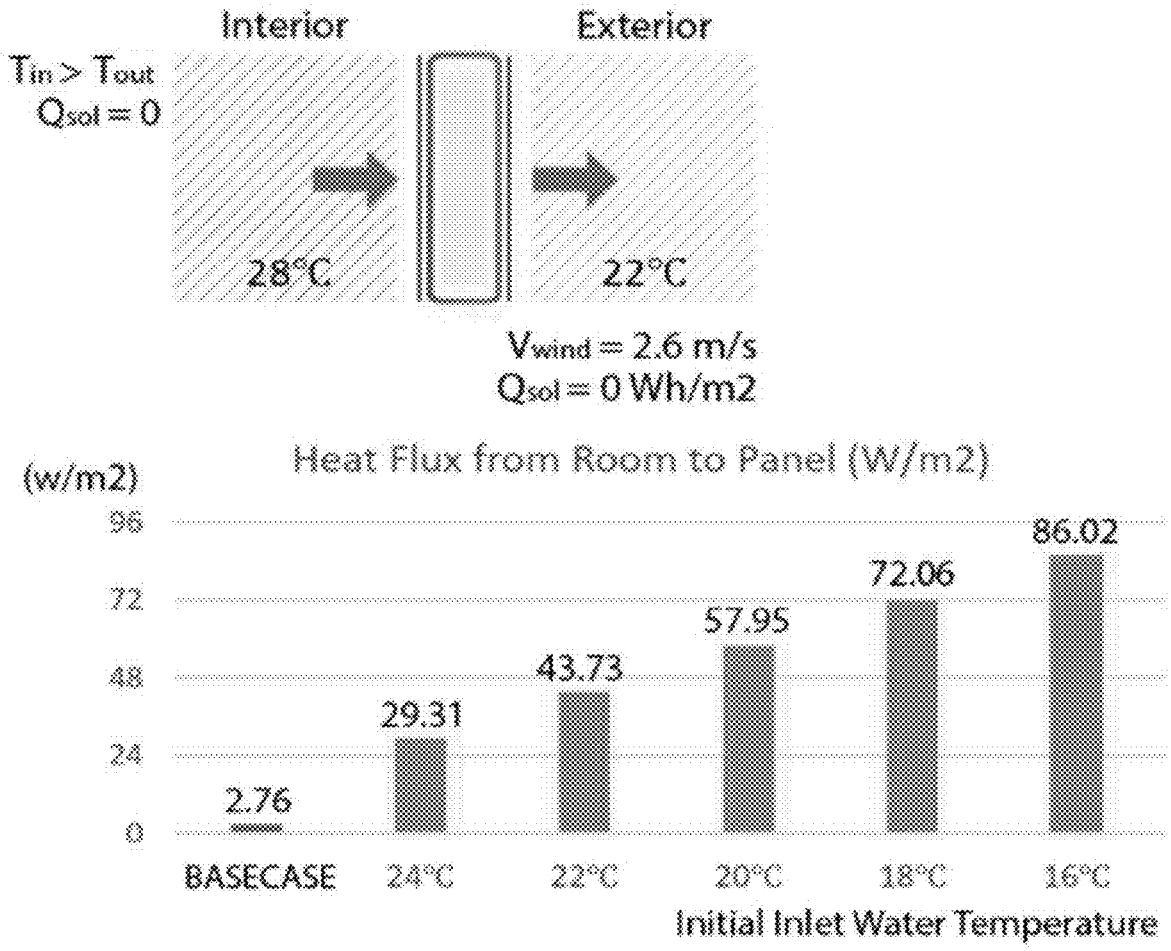
FIG. 13C is a chart showing the results of a hydronic system according to an embodiment of the present technology operating in a heat exchange mode.

FIG. 13C shows the results for the third scenario having the hydronic system 10 operating in the heat exchange mode. $T_{in}$ is 28° C. (82.4° F.), and $T_{out}$ is 22° C. (71.6° F.) without solar incident of the surface. Therefore, the heat exchange mode is required to accelerate heat transfer from the indoor to the outdoor environment.

The hydronic system 10 in these scenarios used geothermal energy for heating and cooling in the isolating mode scenarios. Outdoor wind velocity was included in the scenarios for natural convective heat transfer on the exterior surface. In the first scenario, the base case result shows that the heat flows from the outdoor to the indoor space due to a temperature difference and a solar incident on the surface. However, when the outer microcapillary layer is activated with $T_{inlet}$ from 16° C. (60.8° F.) to 24° C. (75.2° F.), the outer microcapillary layer offsets the thermal load from the solar energy and even provides a cooling impact to the indoor space because the system lowers the wall temperature relative to the indoor air temperature. In the second scenario, the indoor space loses heat as the outdoor temperature is 18° C. (64.4° F.) lower than that of the indoor space. A geothermal loop can provide low-temperature heated water to the inner microcapillary layer for heating, and the results show that even 22° C. (71.6° F.) inlet water temperature, which is close to 18° C. (64.4° F.) indoor air temperature, can provide 28.07 W/m2 (8.89 Btu/ft2 hr) heat flux to the indoor space. The third scenario shows the heat exchange performance between the indoor and outdoor spaces. This scenario can be seen on summer nights. The activation of the hydronic system 10 dramatically accelerates heat transfer from the indoor to the outdoor space for cooling through the use of temperature differences between distinct environments solely without the consumption of any energy sources.

Accordingly, the exemplary hydronic system 10 operating results for various climate conditions shows that hydronic system 10 is dynamically adaptable to the fluctuating exterior and interior environments and occupant comfort need in real-time. The hydronic system 10 is also more energy efficient than conventional building systems because it enables maximizing the direct use of ambient low-grade renewable energy resources to thermoregulate a building.

As will be apparent to those skilled in the art, various modifications, adaptations, and variations of the foregoing specific disclosure can be made without departing from the scope of the technology claimed herein. The various features and elements of the technology described herein may be combined in a manner different than the specific examples described or claimed herein without departing from the scope of the technology. In other words, any element or feature may be combined with any other element or feature in different embodiments, unless there is an obvious or inherent incompatibility between the two, or it is specifically excluded.

References in the specification to "one embodiment," "an embodiment," etc., indicate that the embodiment described may include a particular aspect, feature, structure, or characteristic, but not every embodiment necessarily includes that aspect, feature, structure, or characteristic. Moreover, such phrases may, but do not necessarily, refer to the same embodiment referred to in other portions of the specification. Further, when a particular aspect, feature, structure, or characteristic is described in connection with an embodiment, it is within the knowledge of one skilled in the art to affect or connect such aspect, feature, structure, or characteristic with other embodiments, whether or not explicitly described.

The singular forms "a," "an," and "the" include plural reference unless the context clearly dictates otherwise. Thus, for example, a reference to "a plant" includes a plurality of such plants. It is further noted that the claims may be drafted to exclude any optional element. As such, this statement is intended to serve as antecedent basis for the use of exclusive terminology, such as "solely," "only," and the like, in connection with the recitation of claim elements or use of a "negative" limitation. The terms "preferably," "preferred," "prefer," "optionally," "may," and similar terms are used to indicate that an item, condition, or step being referred to is an optional (not required) feature of the technology.

The term "and/or" means any one of the items, any combination of the items, or all of the items with which this term is associated. The phrase "one or more" is readily understood by one of skill in the art, particularly when read in context of its usage.

Each numerical or measured value in this specification is modified by the term "about." The term "about" can refer to a variation of ±5%, ±10%, ±20%, or ±25% of the value specified. For example, "about 50" percent can in some embodiments carry a variation from 45 to 55 percent. For integer ranges, the term "about" can include one or two integers greater than and/or less than a recited integer at each end of the range. Unless indicated otherwise herein, the term "about" is intended to include values and ranges proximate to the recited range that are equivalent in terms of the functionality of the composition, or the embodiment.

As used herein, unless context indicates otherwise, the terms "interior" and "inside" refer to inside of a particular room or space of a building. As used herein, unless context indicates otherwise, the terms "exterior" and "outside" refer to outside of a particular room or space of a building, which may be outside of the building or inside of another room or space within the building. The terms "interior," "inside," "exterior," and "outside" are not meant to be limiting to any one location or positioning of the technology or any element or feature of the technology.

As will be understood by one skilled in the art, for any and all purposes, particularly in terms of providing a written description, all ranges recited herein also encompass any and all possible sub-ranges and combinations of sub-ranges thereof, as well as the individual values making up the range, particularly integer values. A recited range (e.g., weight percents of carbon groups) includes each specific value, integer, decimal, or identity within the range. Any listed range can be easily recognized as sufficiently describing and enabling the same range being broken down into at least equal halves, thirds, quarters, fifths, or tenths. As a non-limiting example, each range discussed herein can be readily broken down into a lower third, middle third, and upper third, etc.

As will also be understood by one skilled in the art, all language such as "up to," "at least," "greater than," "less than," "more than," "or more," and the like, include the number recited and such terms refer to ranges that can be subsequently broken down into sub-ranges as discussed above. In the same manner, all ratios recited herein also include all sub-ratios falling within the broader ratio. Accordingly, specific values recited for radicals, substituents, and ranges, are for illustration only; they do not exclude other defined values or other values within defined ranges for radicals and substituents.

One skilled in the art will also readily recognize that where members are grouped together in a common manner, such as in a Markush group, the technology encompasses not only the entire group listed as a whole, but each member of the group individually and all possible subgroups of the main group. Additionally, for all purposes, the technology encompasses not only the main group, but also the main group absent one or more of the group members. The technology therefore envisages the explicit exclusion of any one or more of members of a recited group. Accordingly, provisos may apply to any of the disclosed categories or embodiments whereby any one or more of the recited elements, species, or embodiments, may be excluded from such categories or embodiments, for example, as used in an explicit negative limitation.

What is claimed is:

1. A hydronic system for heating and cooling the rooms of a building, comprising:

a partition;

a first conduit embedded in a first side of the partition;

a second conduit embedded in a second side of the partition;

and at least one valve and at least one pump, the at least one valve and the at least one pump are configured to control a flow of a fluid inside the first conduit and the second conduit, wherein, when the hydronic system is operating in an isolating mode, the fluid flows in a first closed loop through the first conduit and the fluid flows in a second closed loop through the second conduit, and when the hydronic system is operating in a heat exchange mode, the fluid flows between the first conduit and the second conduit in a third closed loop.

2. The hydronic system of claim 1, further comprising:

a first sensor configured to detect a first temperature on the first side of the partition;

a second sensor configured to detect a second temperature on the second side of the partition; and a processor configured to select between the isolating mode and the heat exchange mode based on the detected first temperature and the detected second temperature and to control the at least one valve and the at least one pump according to the selected mode.

3. The hydronic system of claim 1, wherein the partition comprises an insulation core, and wherein an effective insulation value of the insulation core changes depending on whether the hydronic system is operating in the isolating mode or the heat exchange mode.

4. The hydronic system of claim 3, wherein the insulation core comprises a rigid foam material.

5. The hydronic system of claim 1, wherein at least one of the first conduit and the second conduit comprises a micro-capillary layer.

6. The hydronic system of claim 5, wherein the micro-capillary layer comprises a plurality of pipes in a parallel arrangement.

7. The hydronic system of claim 5, wherein the micro-capillary layer comprises a plurality of pipes in a honeycomb-shaped arrangement.

8. The hydronic system of claim 5, wherein the micro-capillary layer comprises a continuous pipe having a plurality of bends.

9. The hydronic system of claim 1, wherein at least one of the first conduit and the second conduit comprises a bladder.

10. The hydronic system of claim 1, wherein at least one of the first conduit and the second conduit comprises a plurality of polycarbonate sheets.

11. The hydronic system of claim 1, further comprising a first sheet of finishing material covering the first conduit, and a second sheet of finishing material covering the second conduit.

12. The hydronic system of claim 11, wherein at least one of the first sheet of finishing material and the second sheet of finishing material comprises a fiber-reinforced polymer panel.

13. The hydronic system of claim 1, further comprising a fluid collector in fluid communication with the at least one pump.

14. The hydronic system of claim 1, wherein heat enters the hydronic system through a solar thermal energy collector.

15. The hydronic system of claim 1, wherein heat enters the hydronic system through a geothermal vertical loop.

16. The hydronic system of claim 1, wherein heat leaves the hydronic system through a geothermal horizontal loop.

17. The hydronic system of claim 1, wherein the partition, the first conduit, and the second conduit are provided as a prefabricated partition.

18. A hydronic network for controlling the temperature within a plurality of rooms of a building, the hydronic network comprising:

a plurality of hydronic systems for heating and cooling the rooms of the building, each of the plurality of hydronic systems is integrated into a floor, a ceiling, or a wall of the building, each of the plurality of hydronic systems comprising:

a partition;

a first conduit embedded in a first side of the partition;

a second conduit embedded in a second side of the partition;

a first sheet of finishing material covering the first conduit;

a second sheet of finishing material covering the second conduit; and at least one valve and at least one system pump, the at least one valve and the at least one system pump are configured to control a flow of a fluid inside the first conduit and the second conduit, wherein, when the hydronic system is operating in an isolating mode, the fluid flows in a first closed loop through the first conduit and the fluid flows in a second closed loop through the second conduit, and when the hydronic system is operating in a heat exchange mode, the fluid flows between the first conduit and the second conduit in a third closed loop;

a first sensor configured to detect a first temperature on the first side of the partition; and a second sensor configured to detect a second temperature on the second side of the partition;

a network pump configured to supply the fluid to the plurality of hydronic systems;

a fluid collector in fluid communication with the network pump; and a processor configured, for each of the plurality of hydronic systems, to select between the isolating mode and the heat exchange mode based on the detected first temperature and the detected second temperature and to control the at least one valve and the at least one system pump according to the selected mode.

19. The hydronic network of claim 18, further comprising a solar thermal energy collector configured to supply heat to the hydronic network.

20. The hydronic network of claim 18, further comprising a geothermal vertical loop configured to supply heat to the hydronic network, and a geothermal horizontal loop configured to remove heat from the hydronic network.

* * * * *